US006341985B2

(12) United States Patent
Kodama

(10) Patent No.: US 6,341,985 B2
(45) Date of Patent: Jan. 29, 2002

(54) CONNECTOR UNIT HAVING FRONT HOLDER

(75) Inventor: Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/727,761

(22) Filed: Dec. 4, 2000

(30) Foreign Application Priority Data

Dec. 7, 1999 (JP) ..... 11-347263

(51) Int. Cl.[7] ..... H01R 13/40
(52) U.S. Cl. ..... 439/595
(58) Field of Search ..... 439/752, 594, 439/595, 744, 746

(56) References Cited

U.S. PATENT DOCUMENTS 5,713,761 A * 2/1998 Okayasu ..... 439/595
5,839,914 A * 11/1998 Watanabe et al. ..... 439/488
5,885,105 A * 3/1999 Takagishi et al. ..... 439/595
5,904,593 A * 5/1999 Saito et al. ..... 439/595
5,928,034 A * 7/1999 Tabata et al. ..... 439/595
6,193,551 B1 * 2/2001 Yamamoto et al. ..... 439/595

* cited by examiner

*Primary Examiner*—Brian Sircus
*Assistant Examiner*—Thanh-Tam Le
(74) *Attorney, Agent, or Firm*—Armstrong, Westerman, Hattori, McLeland, & Naughton, LLP

(57) ABSTRACT

In a connector unit 3 comprising a connector housing 1 which includes at least one terminal receiving chamber 8 into which a metal terminal 4 or 5 is inserted from a back side, the metal terminal being locked by a lance 10 for prevention of a backward withdrawal, and a front holder 2 coupled to the connector housing from a front side, the front holder 2 is provided with at least one terminal insertion hole 11 into which a mating terminal T is adapted to be inserted from a front side so as to be connected with the metal terminal, and at least one draw jig hole 13 through which a draw jig 7 is inserted from a front side to force the lance to be elastically deformed thereby to disengage a lock between the lance and the metal terminal. The draw jig hole 13 adjacent to the terminal insertion hole 11 is provided with a guide support section 15 which can guide the draw jig to move back and forth, and bear a reaction force from the lance acting on the draw jig when the lance is disengaged.

5 Claims, 11 Drawing Sheets

CONNECTOR UNIT HAVING FRONT HOLDER

BACKGROUND OF THE INVENTION

1. Field of the Invention

The present invention relates to an improved structure of a connector unit having a front holder.

2. Description of the Related Art

In a conventional connector unit 3 which includes a front holder 2 designed to cover a connector housing 1 as shown in FIGS. 7 and 8, when any of female metal terminals (hereinafter referred to as "terminal") 4, 5 has become defective, it has been common that the terminal is drawn out from the connector unit 3 employing a draw jig 7 having an inserting portion 6 which is in a rectangular shape in cross section as shown in FIG. 9.

A structure of the connector unit 3 will be explained hereunder;

The terminals 4, 5 are inserted into terminal receiving chambers 8 of the connector housing 1 from the back. Each of the inserted terminals 4, 5 is locked by a lance 10 which is abutted against a box-like portion forming a contact portion of the terminal to prevent a so-called backward withdrawal of the terminal, and firmly positioned in the connector housing.

On the other hand, the front holder 2 is coupled to a front of the connector housing 1 so that an interior of the connector unit 3 is completely shut from an exterior.

The front holder 2 of the connector unit 3 thus assembled is provided with terminal insertion holes 11 through which mating male terminals (not shown) are adapted to be inserted for electrical connection with the terminals 4, 5. In addition, draw jig holes 12 in a rectangular shape similar to the inserting portion 6 of the draw jig 7 are formed in the front holder 2 adjacently to the terminal insertion holes 11.

In case where the inserted terminals 4, 5 are electrically defective, or caulking strength at press fitted parts 9 of the terminals 4, 5 is weak, and so on, the terminals 4, 5 must be disengaged from the connector unit 3 to be replaced with new terminals, or to readjust the caulking strength.

In such cases, the draw jig 7 is inserted into the terminal receiving chamber 8 through the draw jig hole 12. A distal end of the draw jig 7 has a rather pointed shape like a bow of a ship, as shown in FIG. 9. In a first step, the distal end is abutted against a distal end of the lance 10 formed of synthetic resin (FIG. 10A), and by further pushing the draw jig 7, the lance 10 is forced to be elastically deformed downward from a state in FIG. 10B to a state in FIG. 10C thereby to disengage the lance 10 from the terminal.

In this state, the defective terminal can be drawn out backward from the terminal receiving chamber 8 and readjusted.

However, when the draw jig 7 is inserted into the draw jig hole 12 in a direction of an arrow A as shown in FIG. 12, and the lance 10 is forced to be elastically deformed downward to be disengaged as shown in FIG. 10, a reaction force acts on the inserting portion 6 of the draw jig 7. Conventionally, during the terminal withdrawing operation, the reaction force has been received only by a partition wall 14 which constitutes a lower edge of tapered edges of the terminal insertion hole 11, existing between the draw jig hole 12 and the terminal insertion hole 11, and which is short in depth dimension. Accordingly, the partition wall 14 receives an upward deforming force from the draw jig 7 and apts to be damaged by the draw jig 7. Moreover, when the mating terminal 15 is inserted into the terminal insertion hole 11 in a direction of an arrow B, it has been concerned that the mating terminal T may be abutted against the partition wall 14 thereby damaging the partition wall 14.

If the partition wall 14 has been broken or damaged in this manner, it has been concerned that the draw jig 7 may intrude into the terminal insertion hole 11, thereby causing a fatal damage on the female terminal 4 or 5.

Further, since the draw jig hole 12 is in a rectangular shape similar to the shape of the distal end of the draw jig 7, there has been such fears that the draw jig 7 itself may be inserted into the draw jig hole 12 upside down, whereby the lance 10 is deformed toward the terminal 4, 5 resulting in a damage of the terminal, or the lance 10 may bite the terminal 4, 5 causing the-connector unit 3 itself to be defective.

In view of the above drawbacks, it is an object of the present invention to provide a connector unit having a front holder in which a guide support section is formed in the draw jig hole in the front holder, thereby to minimize damages or breakdowns of the metal terminals, the front holder, the connector housing, etc.

SUMMARY OF THE INVENTION

In order to attain the above described object, there is provided, according to a first aspect of the present invention, a connector unit having a front holder comprising;

a connector housing which includes at least one terminal receiving chamber into which a metal terminal is inserted from a back side, the metal terminal being locked by a lance for prevention of a backward withdrawal, and a front holder coupled to the connector housing from a front side, the front holder being provided with at least one terminal insertion hole into which a mating terminal is adapted to be inserted from a front side so as to be connected with the metal terminal, and at least one draw jig hole through which a draw jig is inserted from a front side to force the lance to be elastically deformed thereby to disengage a lock between the lance and the metal terminal, the draw jig hole adjacent to the terminal insertion hole being provided with a guide support section which can guide the draw jig to move back and forth, and bear a reaction force from the lance acting on the draw jig when the lance is disengaged.

According to a second aspect of the invention, the guide support section has a determined length in a direction of back and forth movement of the draw jig, whereby the lance can be smoothly disengaged by means of the draw jig.

According to a third aspect of the invention, the draw jig hole has a wall at an area adjacent to the terminal insertion hole.

According to a fourth aspect of the invention, the draw jig hole is composed of a main hole extending away from the terminal insertion hole and lateral holes extending laterally from the main hole, while the draw jig is formed in such a shape in cross section that the draw jig can be correspondingly inserted into the main hole and the lateral holes.

In the connector unit having the front holder according to the first aspect of the invention, the draw jig is guided by the guide support section to move back and forth, and the guide support section receives the reaction force from the lance acting on the draw jig.

In the connector unit having the front holder according to the second aspect of the invention, because the guide support section has a determined length in the moving direction of the draw jig, the draw jig can smoothly move back and forth.

In the connector unit having the front holder according to the third aspect of the invention, because the draw jig hole has the wall at the area adjacent to the terminal insertion hole, strength of the draw jig hole will be enhanced.

In the connector unit having the front holder according to the fourth aspect of the invention, because the draw jig hole is composed of the main hole extending away from the terminal insertion hole and the lateral holes extending laterally from the main hole, the draw jig will not be inserted upside down into the draw jig hole by mistake.

DESCRIPTION OF THE PREFERRED EMBODIMENTS

Figure 1:
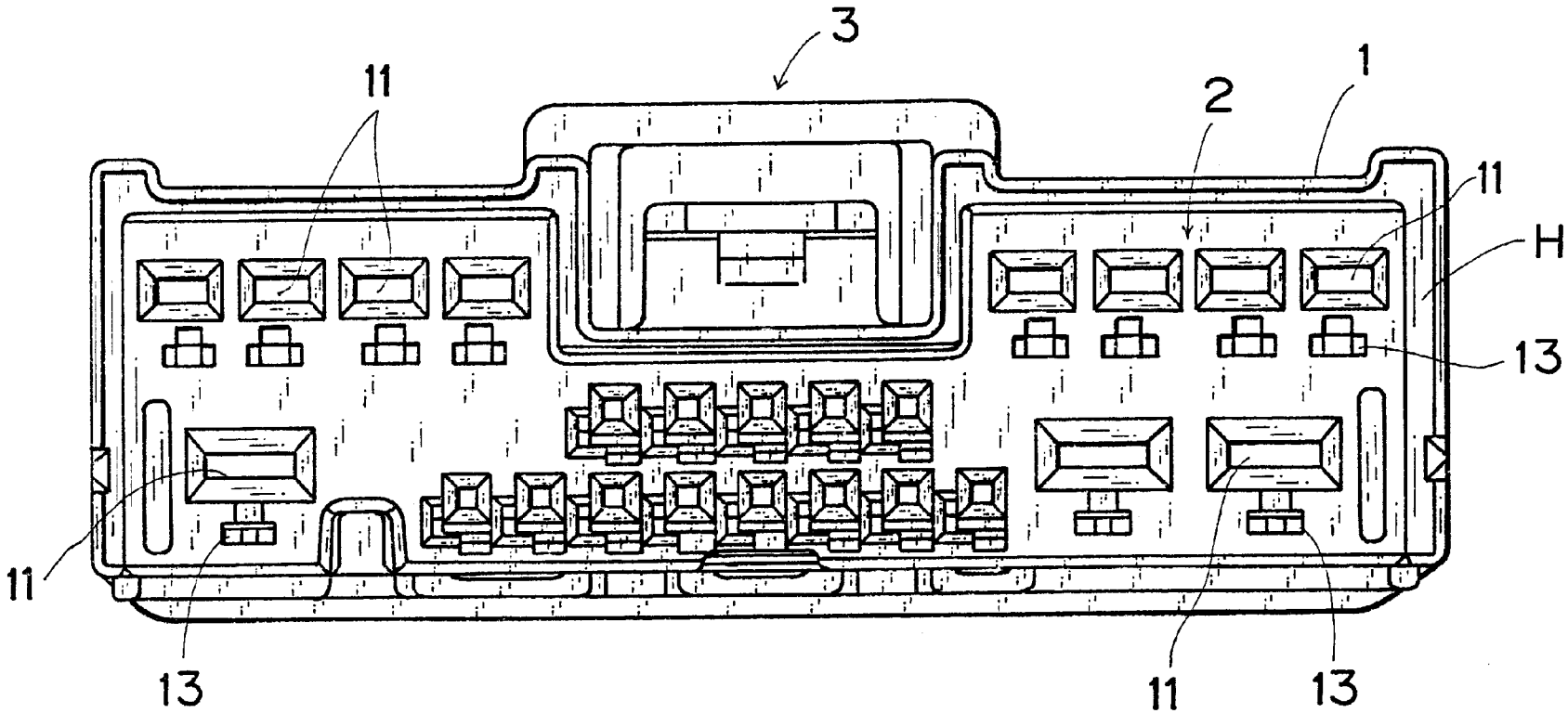
FIG. 1 is a front view of a connector unit having a front holder according to one embodiment of the present invention.

Now, an embodiment of the present invention will be described referring to FIGS. 1 to 6.

Those components substantially identical to those in the conventional structure will be represented by the same reference numerals and an explanation relating to overlapped portions will be omitted.

Figure 2:
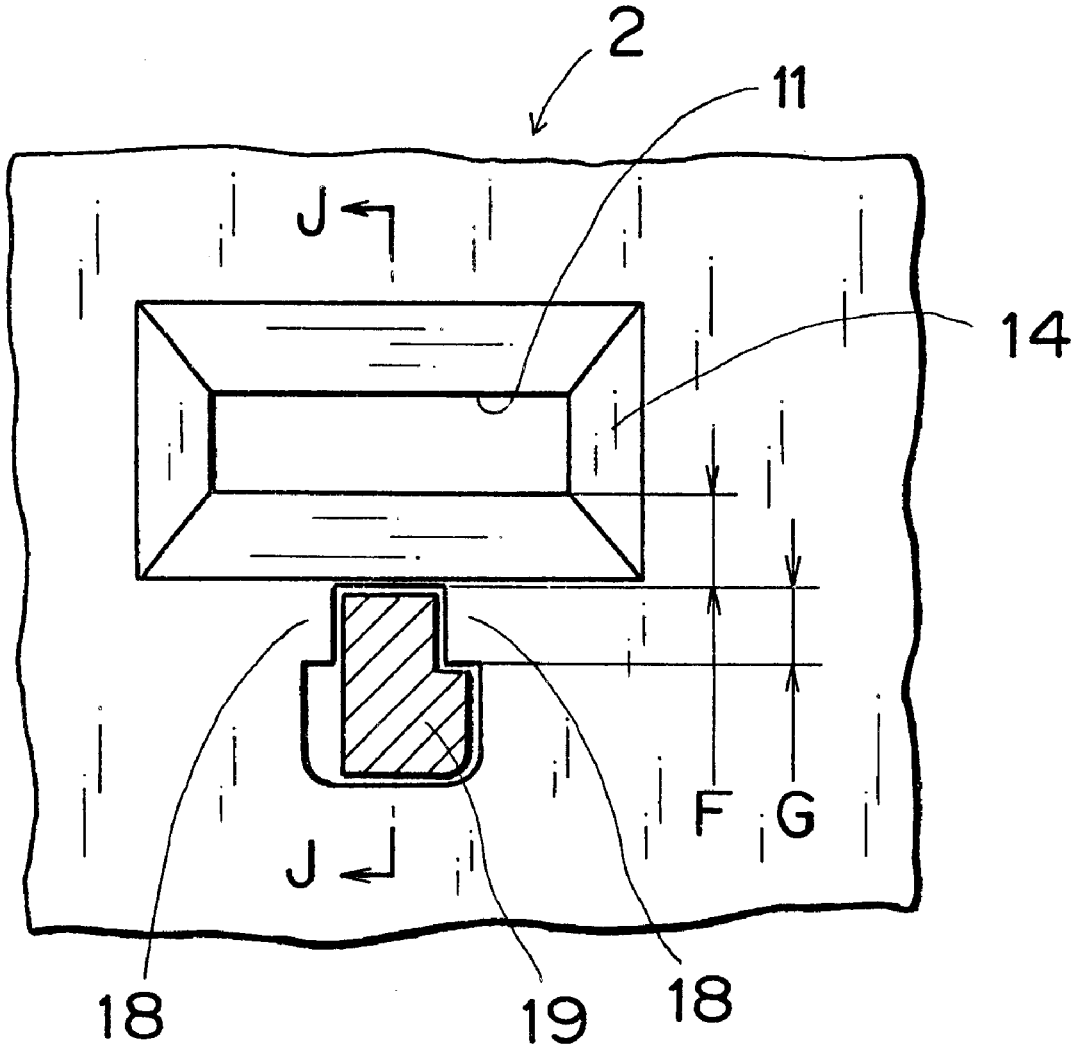
FIG. 2 is an enlarged view of a part H of FIG. 1.
Figure 3A:
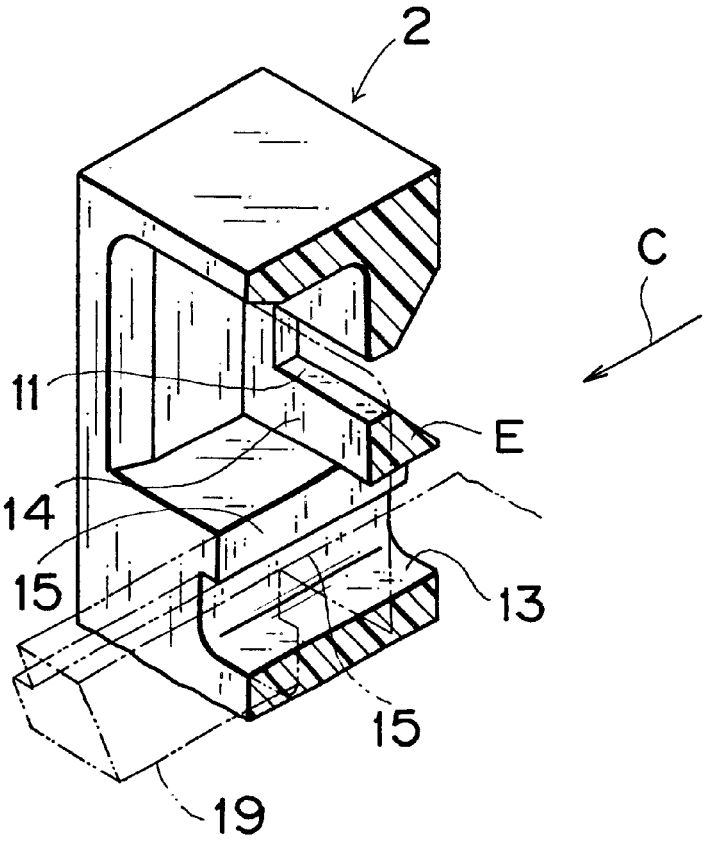
FIG. 3A is an enlarged perspective view of the front holder in cross section, taken along a line J—J of FIG. 2.
Figure 3B:
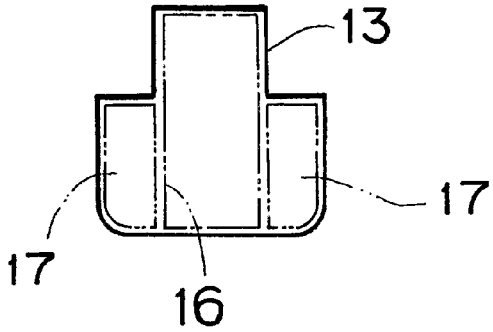
FIG. 3B is a front view for explaining a shape of a draw jig hole.
Figure 4:
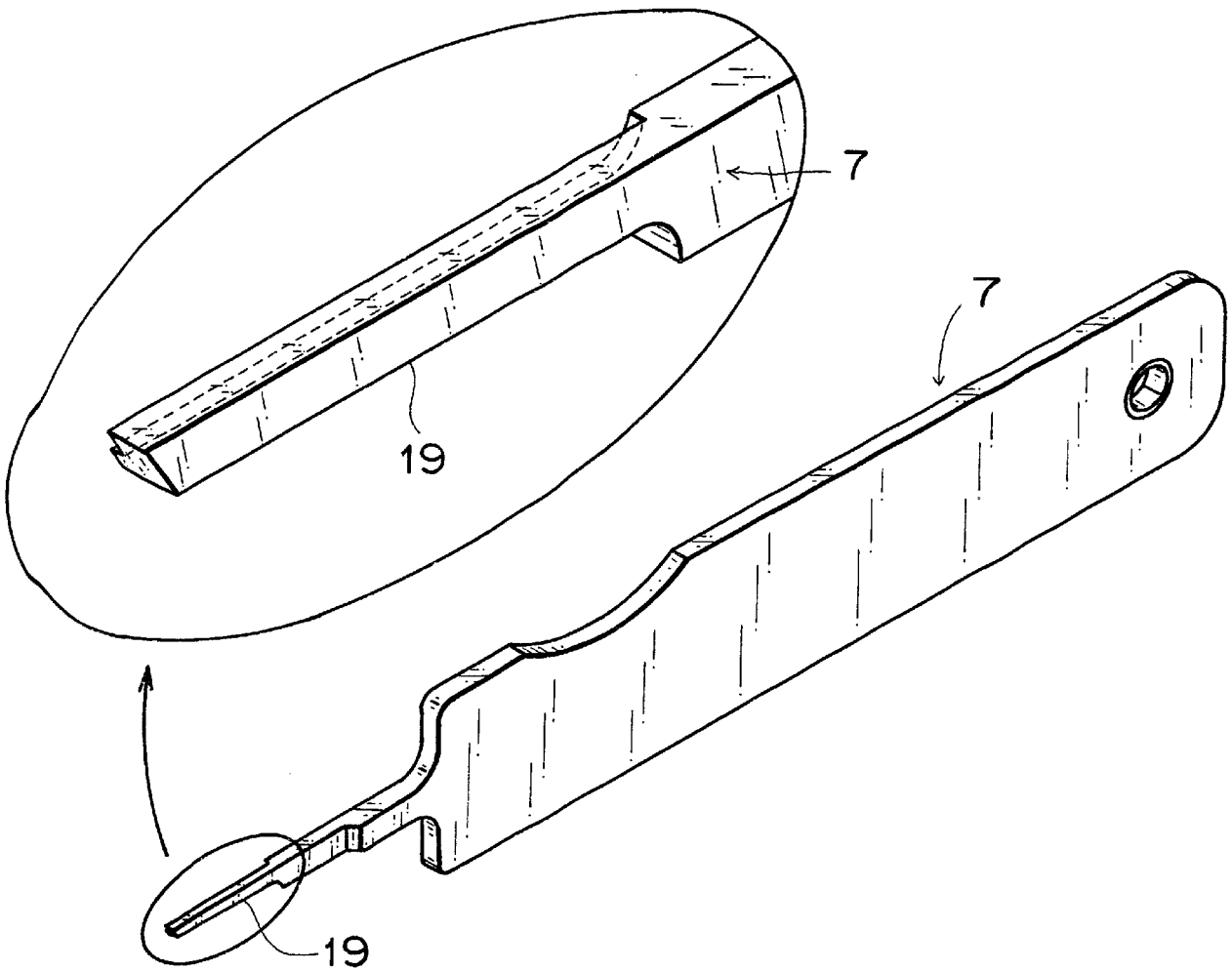
FIG. 4 is a perspective view of the draw jig which is adapted to be inserted into the draw jig hole (encircled is an enlarged perspective view of an essential part thereof)

As shown in detail in FIGS. 2 and 3, a draw jig hole 13 provided in a front holder 2 adjacently to a terminal insertion hole 11 is composed of a main hole 16 extending in a direction away from the terminal insertion hole 11 and lateral holes 17 extending laterally from the main hole 16, generally forming a convex shape or an inverted T shape.

A guide support section 15 is continuously formed in the rear of the draw jig hole 13 maintaining the same convex sectional shape. The guide support section 15 lies below the partition wall 14 and extends therefrom for a determined length in a direction of back and forth movement of the draw jig 7. The guide support section 15 has the same cross sectional shape from the front face through the back face of the front holder. The guide support section 15 is constructed in such a manner that the inserted draw jig 7 can smoothly move back and forth between the lance 10 and the draw jig hole 13, while the inserted draw jig 7 is securely supported with the least play allowing no vertical nor lateral movement around the partition wall 14 located near an inlet of the draw jig hole 13.

Moreover, the draw jig hole 13 is provided with a reinforcing wall 18 at an area adjacent to the terminal insertion hole 11 to enhance strength of the draw jig hole 13. the wall 18 extends backward to constitute a part of the guide support section.

In the meantime, the draw jig 7 to be inserted into the draw jig hole 13 has an inserting portion 19 which is formed in an L shape in cross section. The inserting portion 19 can be inserted into the draw jig hole 13 as shown in FIG. 2, and further inserted into the guide support section 15 thereby to disengage the lock between the terminal 4 or 5 and the lance 10. Accordingly, due to respective shapes of the draw jig hole 13 and the draw jig 7, it is impossible to insert the draw jig 7 upside down into the draw jig hole 13.

Figure 5:
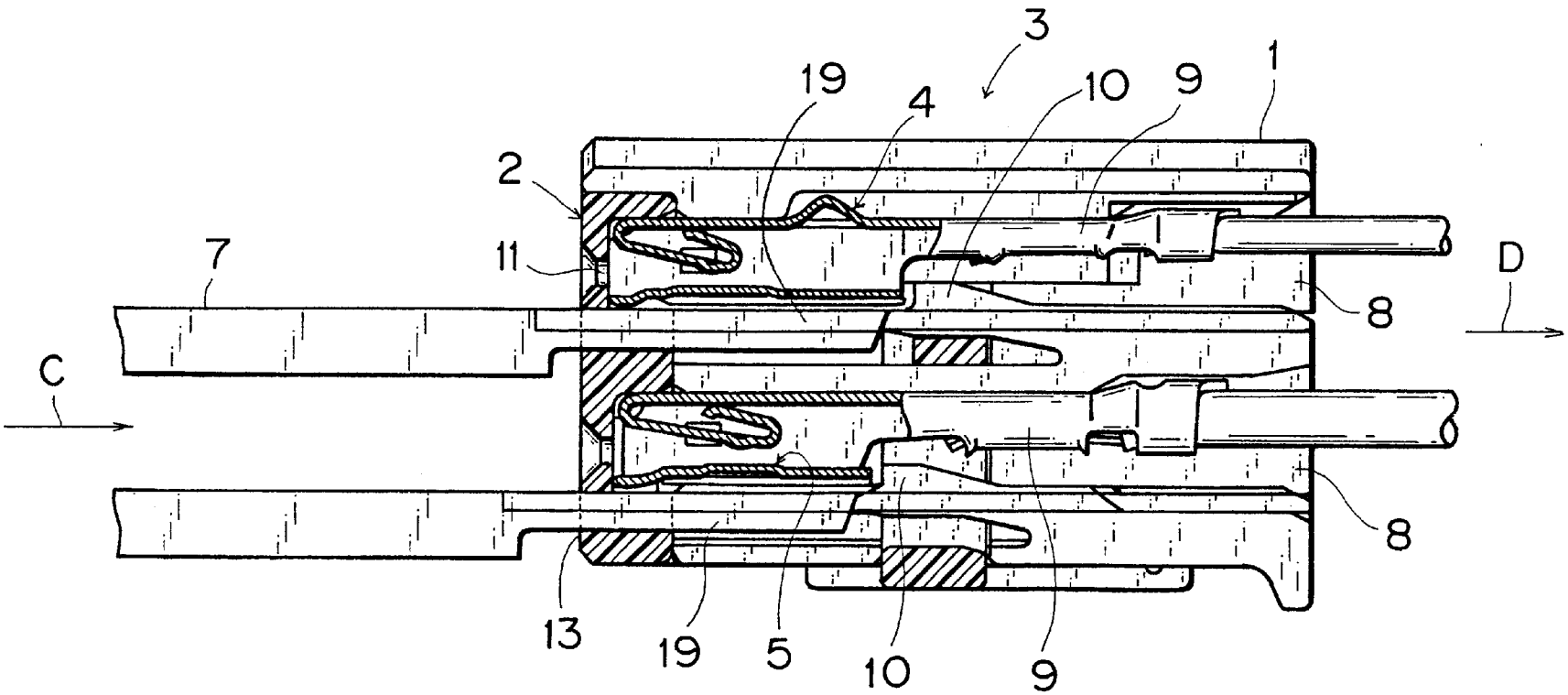
FIG. 5 is a longitudinal sectional view of the connector unit in a state where the draw jig of FIG. 4 has been inserted into the draw jig hole.
Figure 10A:
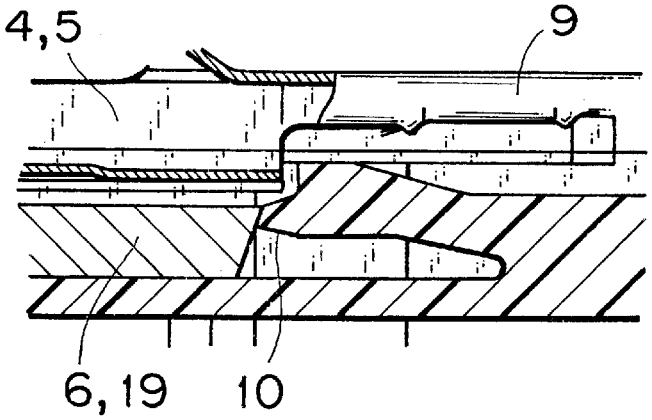
FIG. 10A PRIOR ART
FIGS. 10A, 10B, and 10C are explanatory views showing processes in which a lance is disengaged by means of the draw jig as shown in FIG. 9.
Figure 10B:
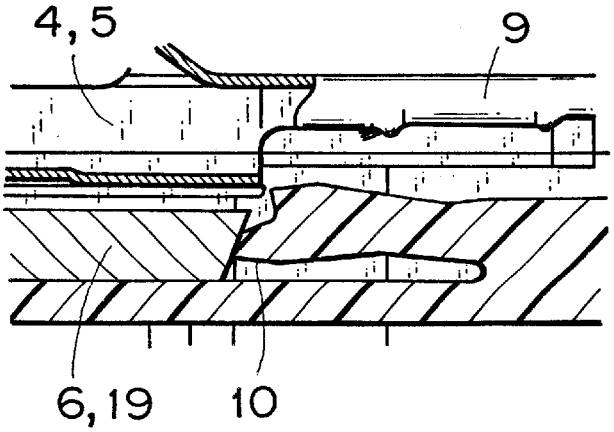
FIG. 10B PRIOR ART
Figure 10C:
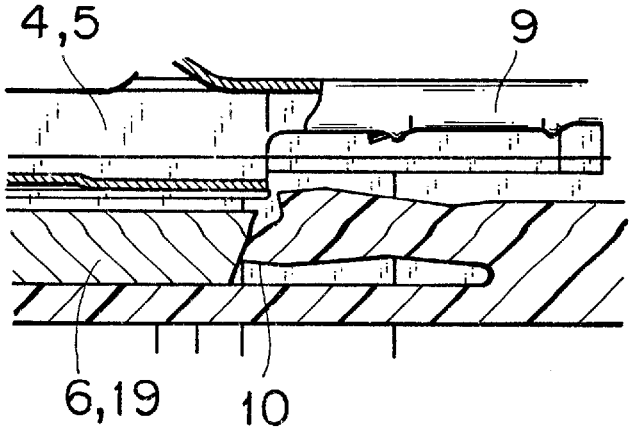
FIG. 10C PRIOR ART
Figure 11:
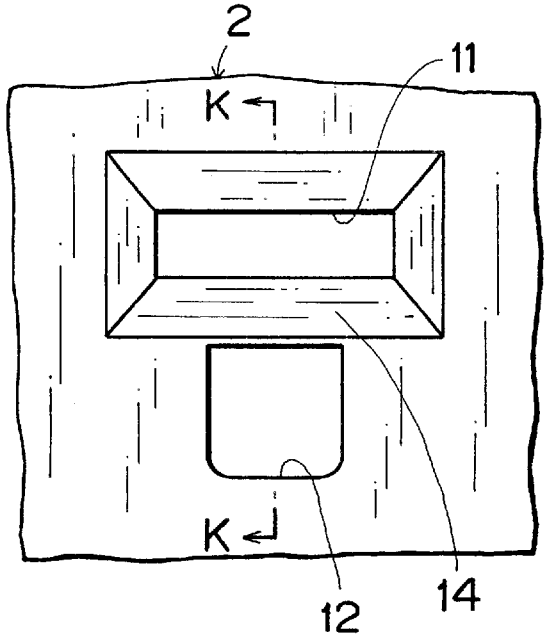
FIG. 11 PRIOR ART
FIG. 11 is a front view of an essential part of the front holder showing a positional relation between the draw jig hole and the terminal insertion hole.
Figure 12:
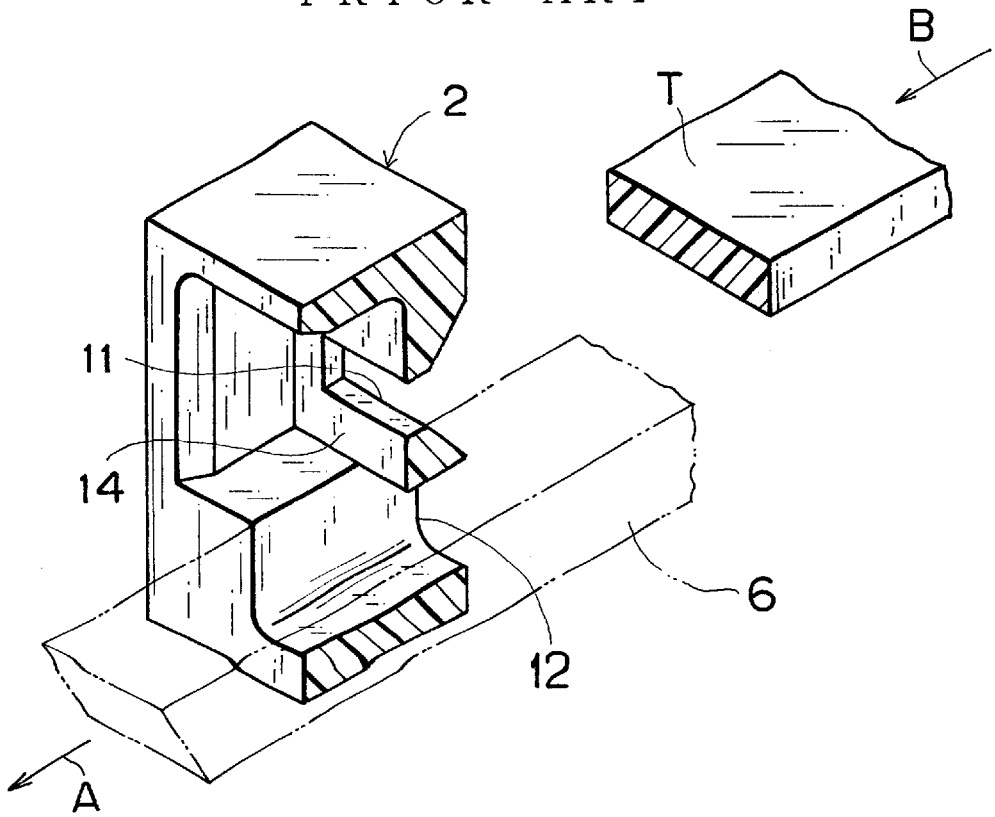
FIG. 12 PRIOR ART
FIG. 12 is an enlarged perspective view of a part of the front holder of FIG. 11 taken along a like K—K, showing a state where the draw jig has been inserted into the draw jig hole.

After the terminals 4, 5 are assembled in the connector housing 1 as shown in FIG. 5, the front holder 2 is coupled to the connector housing 1 from the front side so as to cover it. In order to remove the terminal 4 or 5 from the thus assembled connector unit 3, the draw jig 7 is inserted into the draw jig hole 13 in a direction of an arrow C from the front side of the front holder 2, until the distal end of the inserting portion 19 comes in contact with the distal end of the lance 10. Pushing further the draw jig 7 from a state in FIG. 10B to a state in FIG. 10C, the lance 10 will be disengaged from the lock with the terminal 4 or 5. In this manner, the terminal 4 or 5 can be smoothly taken out from the terminal receiving chamber 8 of the connector housing 1 in a direction of an arrow D.

In the described embodiment, the draw jig 7 is guided by the guide support section 15 to be led to the lance 10. The reaction force acting on the draw jig 7 when the lance is disengaged from the terminal 4 or 5 will be received by the guide support section 15 of the connector housing. Accordingly, such a fear that the lance or the terminal may be damaged or broken by imparting a plying force to the lance 10 through the draw jig 7 can be reliably eliminated.

Moreover, because the draw jig hole 13 is in a convex shape while the inserting portion of the draw jig 7 is in an L shape, insertion of the draw jig upside down can be reliably avoided. As the result, such a fear that the lance 10 may be pushed toward the terminal at the opposite side thereby damaging the lance or making the connector unit 3 itself unusable can be eliminated.

Further, because of the presence of the wall 18 between the terminal insertion hole 11 and the draw jig hole 13, a shearing area of a conventional tab receiving portion E which has been F will be increased by G. As the result, the strength around the draw jig hole 13 will be substantially increased, and the partition wall 14 will not be lost or damaged. Thus, a faulty insertion of the draw jig 7 can be reliably avoided.

Although the present invention has been fully described referring to the embodiment, the present invention is not limited to the above described embodiment, but various changes and modifications within a scope of the invention will be included in the present invention.

Figure 6A:
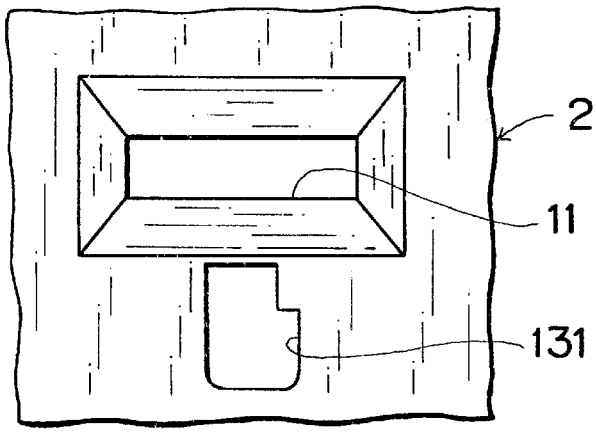
FIGS. 6A, 6B and 6C are respective front views of the draw jig holes according to the embodiment in modified cases.
Figure 6B:
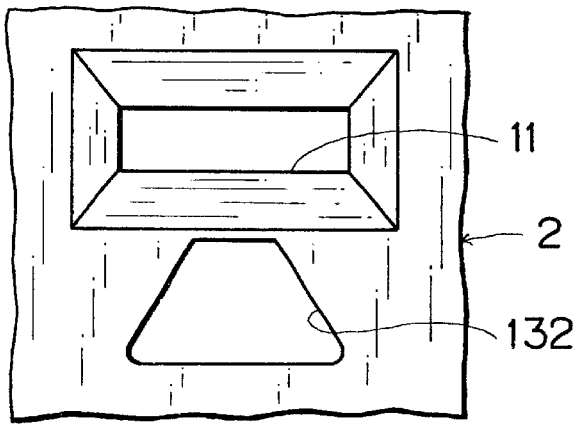
Figure 6C:
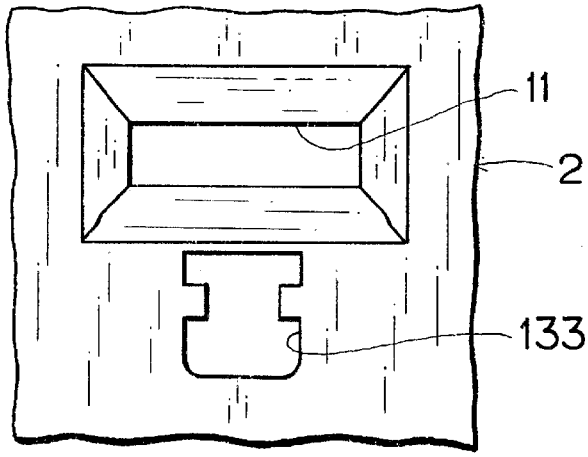
Figure 7:
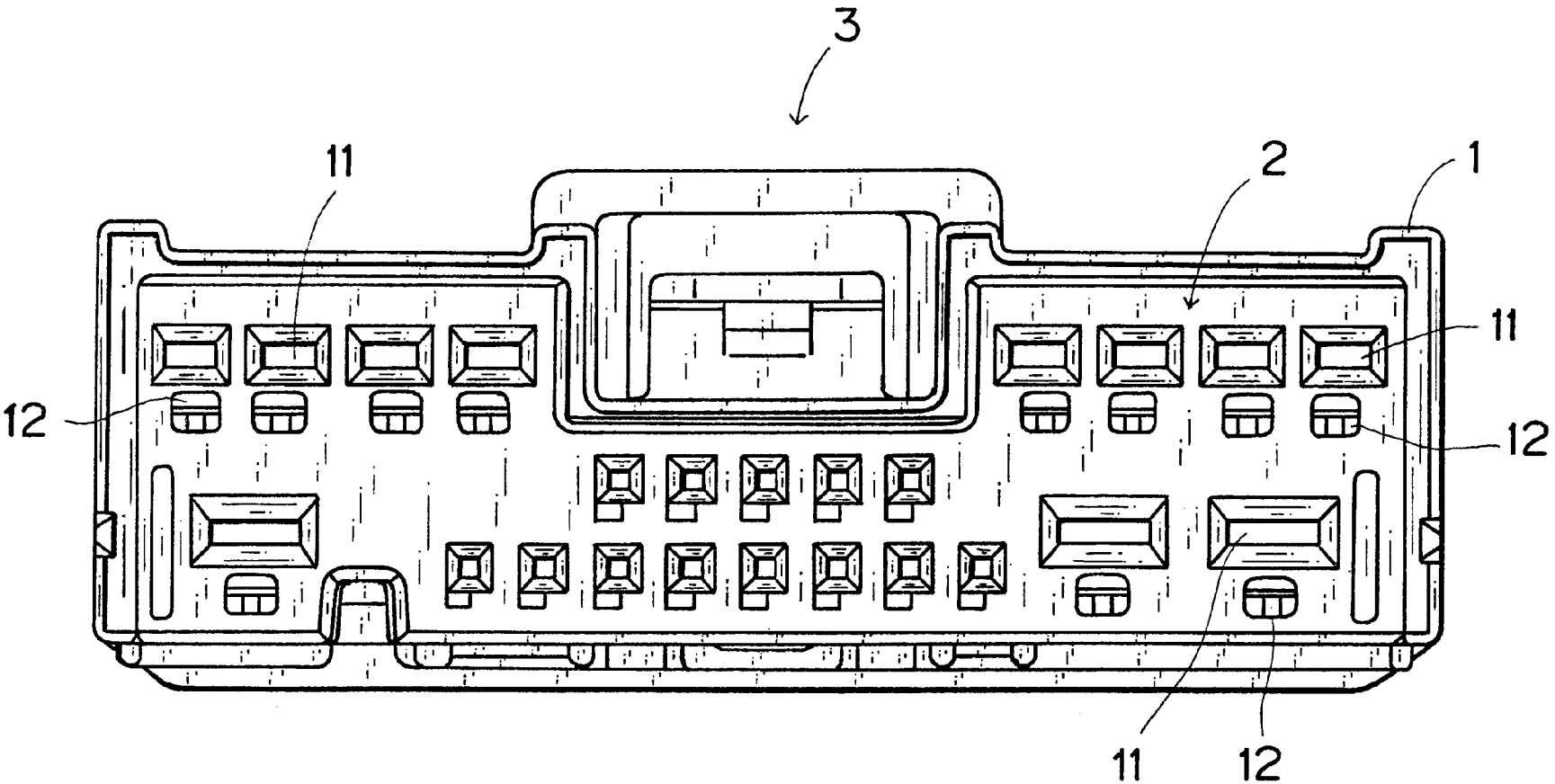
FIG. 7 PRIOR ART
FIG. 7 is a front view of a connector unit having a front holder of a conventional structure.
Figure 8:
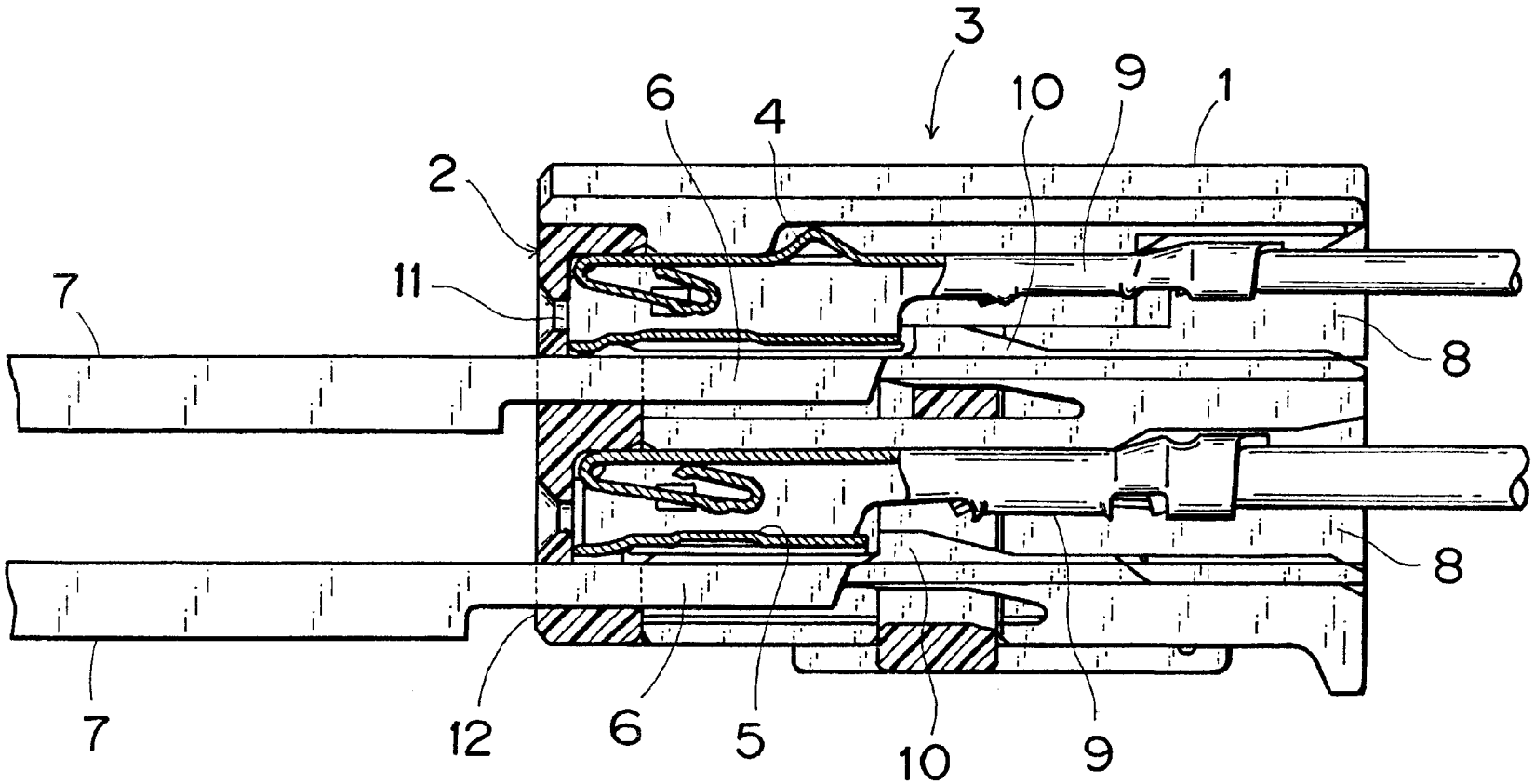
FIG. 8 PRIOR ART
FIG. 8 is a longitudinal sectional view of the connector unit in a state where the draw jig has been inserted into the draw jig hole in the connector unit of FIG. 7.
Figure 9:
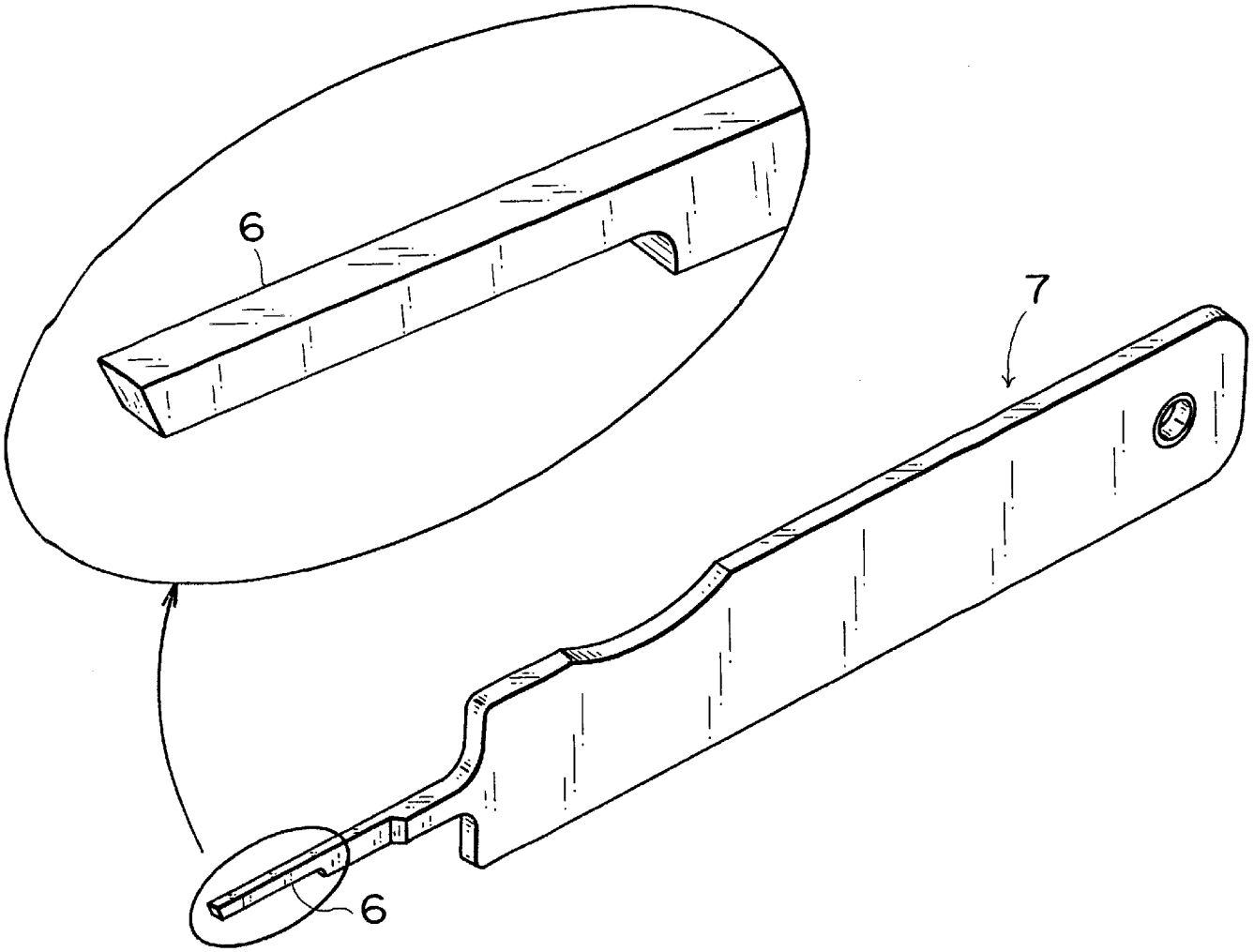
FIG. 9 PRIOR ART
FIG. 9 is a perspective view of the draw jig as shown in FIG. 8 (encircled is an enlarged perspective view of an essential part thereof)

For example, the draw jig hole 13 may be in a form of a hole 131 in an L shape as shown in FIG. 6A, in a form of a hole 132 in a trapezoidal shape as shown in FIG. 6B, or in a form of a hole 133 having a shape as shown in FIG. 6C. The inserting portion 19 of the draw jig may be in a convex shape or an inverted T shape in cross section similarly to the draw jig hole, instead of the L shape.

What is claimed is:

1. A connector unit having a front holder comprising;

a connector housing which includes at least one terminal receiving chamber into which a metal terminal is inserted from a back side, said metal terminal being locked by a lance for prevention of a backward withdrawal, and a front holder coupled to said connector housing from a front side, said front holder being provided with at least one terminal insertion hole into which a mating terminal is adapted to be inserted from a front side so as to be connected with said metal terminal, and at least one draw jig hole through which a draw jig is inserted from a front side to force said lance to be elastically deformed thereby to disengage a lock between said lance and said metal terminal, said at least one terminal insertion hole and said at least one draw jig hole being separated by a partition wall, and said at least one draw jig hole being provided with a guide support section adjacent to said partition wall and extending in a direction of back and forth movement of said draw jig, which guides said draw jig to move back and forth, and can bear a reaction force from said lance acting on said draw jig when said lance is disengaged.

2. The connector unit having the front holder as claimed in claim 1, wherein said guide support section has a determined length in a direction of back and forth movement of said draw jig, whereby said lance can be smoothly disengaged by means of said draw jig.

3. The connector unit having the front holder as claimed in claim 1 or 2, wherein said draw jig hole has a reinforcing wall at an area adjacent to said terminal insertion hole.

4. A connector unit, comprising;

a connector housing which includes at least one terminal receiving chamber into which a metal terminal is inserted from a back side, said metal terminal being locked by a lance for prevention of a backward withdrawal, and a front holder coupled to said connector housing from a front side, said front holder being provided with at least one terminal insertion hole into which a mating terminal is adapted to be inserted from a front side so as to be connected with said metal terminal, and at least one draw jig hole through which a draw jig is inserted from a front side to force said lance to be elastically deformed thereby to disengage a lock between said lance and said metal terminal, said at least one draw jig hole adjacent to said at least one terminal insertion hole being provided with a guide support section which guides said draw jig to move back and forth, and can bear a reaction force from said lance acting on said draw jig when said lance is disengaged, wherein said draw jig hole has a wall at an area adjacent to said terminal insertion hole, and said draw jig hole is composed of a main hole extending away from said terminal insertion hole and lateral holes extending laterally from said main hole, while said draw jig is formed in such a shape in cross section that said draw jig can be correspondingly inserted into said main hole and said lateral holes.

5. A connector unit comprising;

a connector housing which includes at least one terminal receiving chamber into which a metal terminal is inserted from a back side, side metal terminal being locked by a lance from prevention of a backward withdrawal, and a front holder coupled to said connector housing from a front side, said front holder being provided with at least one terminal insertion hole into which a mating terminal is adapted to be inserted from a front side so as to be connected with said metal terminal, and at least one draw jig hole through with a draw jig is inserted from a front side to force said lance to be elastically deformed thereby to disengage a lock between said lance and said metal terminal, said at least one draw jig hole adjacent to said at least one terminal insertion hole being provided with a guide support section which guides said draw jig to move back and forth, and can bear a reaction force from said lance acting on said draw jig when said lance is disengaged, wherein said guide support section has a determined length in a direction of back and forth movement of said draw jig, whereby said lance can be smoothly disengaged by means of said draw jig, said draw jig hole has a wall at an area adjacent to said terminal insertion hole, and said at least one draw jig hole is composed of a main hole extending away from said terminal insertion hole and lateral holes extending laterally from said main hole, while said draw jig is formed in such a shape in cross section that said draw jig can be correspondingly inserted into said main hole and said lateral holes.

* * * * *